United States Patent [19]

Grossmann et al.

[11] 4,327,551

[45] May 4, 1982

[54] MULTI-CYLINDER HOT-GAS ENGINE WITH AUTOMATIC AIR AND GAS SUPPLY

[75] Inventors: Joachim Grossmann; Heinz Hoff, both of Augsburg, Fed. Rep. of Germany

[73] Assignee: M.A.N. Maschinenfabrik Augsburg-Nürnberg Aktiengesellschaft, Augsburg, Fed. Rep. of Germany

[21] Appl. No.: 151,883

[22] Filed: May 21, 1980

[30] Foreign Application Priority Data

Jun. 2, 1979 [DE] Fed. Rep. of Germany ..... 2922603

[51] Int. Cl.[3] ..... F02G 1/04

[52] U.S. Cl. ..... 60/524; 60/525

[58] Field of Search ..... 60/524, 525, 517

[56] References Cited

U.S. PATENT DOCUMENTS 3,822,550 7/1974 Brandenburg et al. ..... 60/524

3,956,892 5/1976 Nystrom ..... 60/524

*Primary Examiner*—Allen M. Ostrager

*Assistant Examiner*—Stephen F. Husar

*Attorney, Agent, or Firm*—Frishauf, Holtz, Goodman & Woodward

[57] ABSTRACT

The temperature of the working gas in the heating chamber of each of a number of cylinders is continuously measured. An electronic selection circuit selects the lowest measured temperature as a control parameter by which the speed of a blower in the common air supply is controlled for providing an air flow proportional to blower speed. A pressure-detecting device measures the air flow through a pressure converter provides an electrical signal that normally controls the valves of the respective fuel supplies for the combustion chambers of the cylinders, but a monitoring device for each cylinder compares the measured working gas temperature with a pre-set maximum value so that when the maximum value is exceeded, the fuel supply valve is changed over to control by the output of the monitoring device, to reduce the fuel supply until the maximum temperature is no longer exceeded in that cylinder. For still a higher temperature of the working gas in any cylinder, determined by another sensor, a general shutdown valve reduces the common fuel supply. An auxiliary air supply provides atomizing air for fuel injection.

7 Claims, 1 Drawing Figure

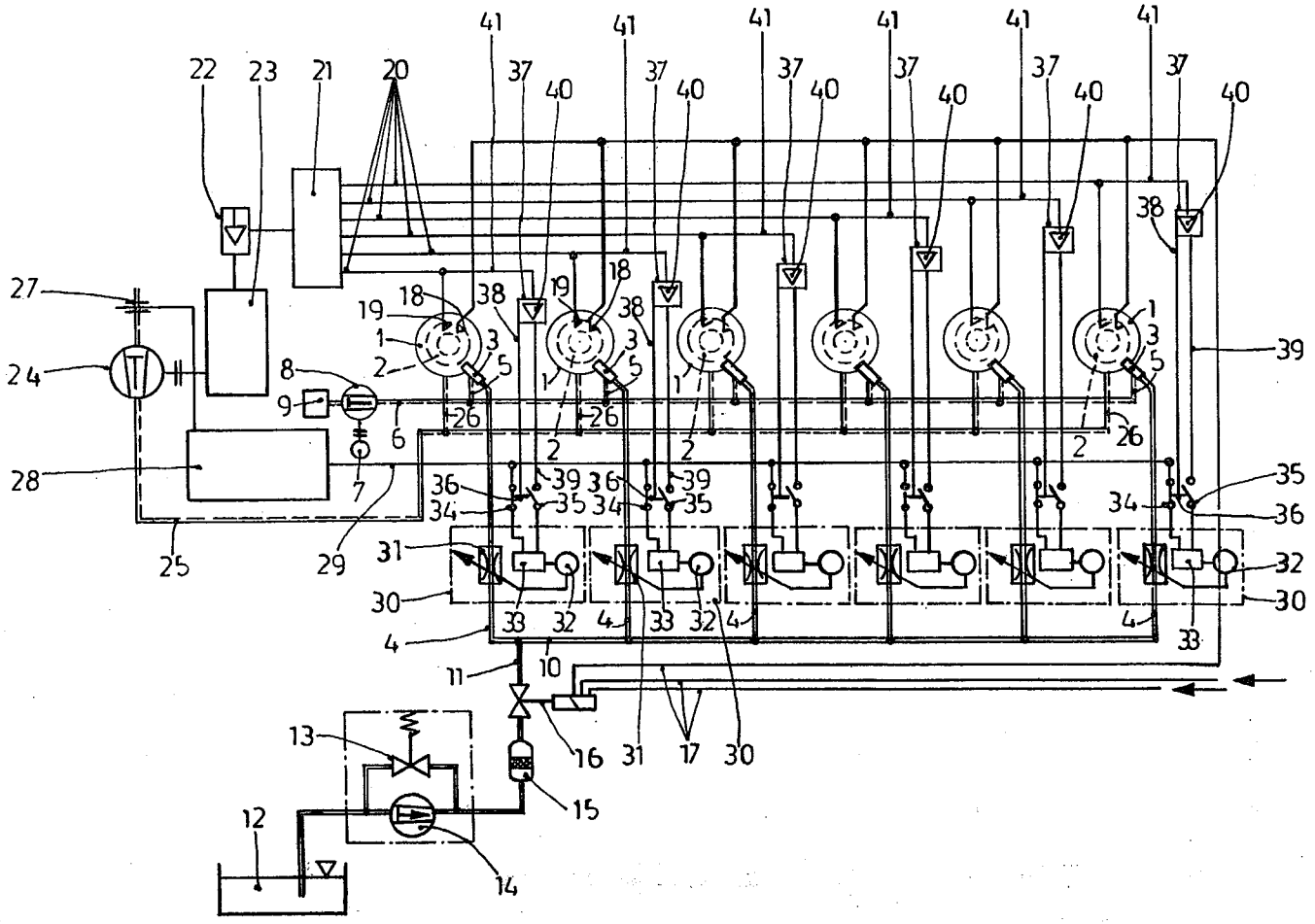

MULTI-CYLINDER HOT-GAS ENGINE WITH AUTOMATIC AIR AND GAS SUPPLY

This invention concerns a multi-cylinder hot-gas engine equipped with an air-fuel supply that is controlled with reference to the hot-gas temperatures in the several cylinders thereof.

An external combustion engine is known from German published patent application No. OS 26 45 376 in which fuel and air are supplied to the combustion chamber of the engine in a ratio controllable by a regulating system operating in response to temperature changes resulting from variations in load on the motor. In this engine, the temperature measured on the outside of heater tubes in which the working gas is heated serves as the control parameter and corresponding signals therefrom are supplied to a control system which adjusts the supply of combustion air proportional to the difference between actual value and reference value of temperature, and the supply of fuel is kept proportional to the amount of air supplied.

In the control system of this known engine, the air flow produced by a blower and set in magnitude by a particular position of a throttle valve in the supply line influences the through-flow cross-section of the fuel line and, hence, the amount of fuel coming through, by means of a nozzle directed on a membrane valve of which the membrane carries a closing member.

The above-described control system has, however, certain disadvantages resulting from the limitations of the components used. For example, the temperature is measured by thermal elements applied externally to the heater tubes, instead of measuring the actual temperature of the working gas which represents an exact basis for the effective control of the air and fuel supply. Furthermore, by the use of a variable position throttle in the air supply line, a blower is made necessary that must always—most of the time uneconomically—supply the maximum air flow, of which only a part is passed on to the combustion chamber. Furthermore, the air-flow-dependent control of the fuel flow cross-section by means of the membrane valve seems relatively susceptible to mechnical influences such as shaking, pressure variations, impurities or coatings at the valve passage. Furthermore, the known control is designed for the air and fuel supply of only one combustion chamber.

SUMMARY OF THE INVENTION

It is an object of the present invention to provide a multi-cylinder hot-gas engine with a control system that optimizes power output and by which the air and fuel supply for all combustion chambers is controlled with a minimum expense for components with the greatest possible reliability and function.

Briefly, a measuring device for monitoring the working gas temperature is provided within each heating chamber (in the heating chamber of each cylinder); means are provided for selecting the lowest working gas temperature measured thereby in the various cylinders and for controlling, in response thereto, the air supply for all combustion chambers; fuel supply control means having a throttle valve and an electrical valve setting mechanism are interposed in each of the respective fuel supply lines individually feeding the several combustion chambers (one combustion chamber adjoining each heating chamber); means are providing for supplying to each fuel supply control, simultaneously, a fuel control signal proportional to the quantity of air required to the combustion chambers; and each combustion chamber is equipped with safety monitoring means for producing a reduction of the fuel throughput to that one of said fuel control means which feeds a cylinder in the heating chamber of which the temperature rises beyond a predetermined limit value.

The means for selecting the lowest of the heating chamber temperatures is preferably an electronic selection logic that furnishes a signal corresponding to the lowest measured heating-chamber temperature as the control parameter to an air flow control system serving all combustion chambers. This provides an optimum feed of air. Since the fuel normally supplied for all combustion chambers is proportional to the air supplied in common to all combustion chambers, each fuel supply is additionally made reducible by the same fuel supply device in response to a monitoring system that acts whenever the temperature in the corresponding combustion chamber exceeds a preset limit value.

A control system is thus provided for the engine that optimizes in a fully automatic fashion the air-fuel supply to each individual combustion chamber with a minimum expense for components.

Preferably and more particularly, the fuel supply control for each individual combustion chamber has two electrical inputs alternatively connected by means of a changeover switch which can be changed over to provide a fuel rate reducing signal in response to detection of an excessive temperature in the corresponding heating chamber of the monitoring system of the particular cylinder. The monitoring system operates on a temperature limit setting, slightly above the temperature reference value, with reference to which the air supply for all cylinders is controlled.

BRIEF DESCRIPTION OF THE DRAWING

The invention is further described by way of an illustrative example with reference to the annexed drawing, the single FIGURE of which is a diagram showing the cylinders of a multi-cylinder hot-gas engine and the air and fuel supply for the combustion chambers as well as the control system for the air and fuel supply, but leaving out features of the engine which have nothing to do with the invention.

DESCRIPTION OF AN ILLUSTRATIVE EMBODIMENT

As already mentioned, in the drawing, much of the construction and features of the hot-gas engine represented in the diagram have been left out, this being done in order to make the representations of the features shown more evident and intelligible. In particular the internal working gas loop of the motor is largely left out and furthermore, of the assemblies grouped around the respective cylinders illustrated side by side in a row, only two are fully designated with reference numerals because of the fact that each cylinder assembly is identically equipped. The same reference numerals apply and could be applied to identical parts of the several assemblies.

The cylinders themselves are not illustrated as such, but for each cylinder there is diagrammatically shown in the drawing a combustion chamber 1 which adjoins a heating chamber 2 containing a working gas. Atomizing nozzles 3 are supplied with fuel over fuel supply lines 4 and with atomizing air over air supply lines 5. The latter are connected to a common supply duct 6 at the input end of which there is connected atomizing air blower 8 equipped with an air filter 9 driven by an electric motor 7.

The fuel supply lines 4 are likewise connected to a common supply pipe 10 into which the main fuel conduit 11 discharges. The latter is connected at its input end with a fuel tank from which the fuel can be supplied by means of a fuel pump 14 having an overpressure valve 13, the fuel being supplied through a fuel filter 15 and a normally open fuel shutoff valve 16. The fuel shutoff valve 16 is constituted as a magnetic valve and serves as a safety valve, for use in the case of a malfunction, for producing a complete suppression of the fuel supply. The fuel shutoff valve 16 is connected through electric connection 17 with a number of control elements responsive to various functional elements of the hot-gas motor. One of these connections serves, for example, as a collecting line for the signals of thermosensitive devices 18 located internally of the heating chambers 2. These devices are set for a maximum temperature value so that upon this maximum temperature value being exceeded a signal can be provided to the fuel shutoff valve 16 to produce a shutdown of fuel supply. The system just described for closing down the common fuel supply is not the monitoring system for the individual cylinders that has been briefly mentioned above and has yet to be described.

For the purpose of the temperature sensitive control system for air and fuel now to be described, there is provided within each heating chamber 2 the thermosensitive measuring device 19, each of which is connected by an output conductor 20 to a corresponding input of an electronic selection logic circuit 21. This logic circuit 21 continuously evaluates the working gas temperatures measured in each heating chamber and supplied by measuring signals to the logic circuit, selects a signal corresponding to the lowest of these measured working gas temperatures and furnishes an output signal corresponding thereto through a channel connecting it to an air-flow control device 22 as the control parameter therefor. The air-flow control device 22 is set to a particular reference value for comparison with the control signal supplied to it in order to produce an output signal which may be referred to as an "error" signal in conventional servo or control system terminology.

On its output side, the air-flow control device 22 is connected to a drive mechanism 23 for a blower 24, which last supplies air through a common means supply duct 25 and then through branch lines 26 to the individual combustion chambers. The drive mechanism 23 is so designed that the rate of rotation of the blower 24 can be controlled in a stepless manner over a relatively large range. For this purpose, this drive mechanism comprises an electric motor and either a brush-shifting positioning motor or a continuously variable belt drive, cooperating with the drive motor.

The speed control of the blower 24 is produced by the air-flow control device 22 in dependence upon comparison of the control-parameter signals supplied to it with the reference value to which the device is set.

The air flow provided simultaneously to all combustion chambers 1 is therefore dependent upon the blower speed set by the control system just described. The air flow thus provided represents the control parameter for the fuel supply simultaneously provided to the individual combustion chambers.

For the measurement of the air flow being supplied to all combustion chambers, a measuring device 27 is provided in the supply line either ahead of the blower 24 as shown in the diagram or, alternatively, downstream from it. The measuring device 27 detects the flow pressure and supplies the detected pressure to a pressure converter 28 which converts the measured flow pressure into an electric signal proportional thereto, preferably an electrical voltage. On the output side of the pressure converter 28 are a common control line 29 leading to the fuel supply control means 30, each of which is associated with one combustion 1 and is interposed in the fuel supply line for the particular combustion chamber.

Each fuel supply means 30 consists of a throttle valve 31 and an electrical valve setting mechanism. The latter is composed of a stepping motor 32 and the actuatable part of the throttle valve 31 that varies the flow-through aperture cross-section and, also, an electrical control device 33 for the stepping motor having two alternatively connectable inputs 34 and 35. The control device 33 in the illustrated example is constituted as an electronic analog-to-digital converter which converts the electrical analog value signal provided by the pressure converter 28 into electrical stepping pulses for the stepping motor 32.

The first inputs 34 of all fuel supply control means 30 are in each case connected over a first switching path of electrical change-over switch 36 to the control line 29 coming from the pressure converter 28. This first path of the change-over switch 36 is as a rule enabled, so that a single control signal from the pressure converter 28 is capable of simultaneously controlling all the fuel control means for a particular fuel supply rate.

The electrical change-over switches are subject on occasion to an electrical changeover command signal transmitted from a monitoring device 37 individual to the particular heating chamber and connected by a line 38 so that the change-over signal will switch the input of the fuel supply means from the first switching path to the second of the change-over switch, after which control signals can be fed to the electrical control device of the fuel supply control means from the monitoring device 37 over the connection line 39.

The monitoring devices 37 serve as maximum setting devices and consist in each case of a control device 40 set for a reference temperature set at a value a little higher than the reference value set for the air flow control 22. The control device 40 is in each case continuously supplied, over a connection 41, with the working gas temperature value of the particular heating chamber 2 measured by the thermosensitive device 19.

These currently measured temperature values are compared by the respective monitoring devices 37 with the maximum values set therein so that when the reference maximum value is overstepped by the measured working gas temperature value, a switchover command will be provided by the monitoring device over the line 38 to the corresponding changeover switch 36, as the result of which the fuel supply control means 30 is disconnected from the common control for all combustion chambers and is connected to control signals from the corresponding device 40, over the connection 39, to the second input 35 of the electrical control device 33 of the valve setting mechanism for the purpose of reducing the flow of fuel to the corresponding combustion chamber.

This control path remains connected until the reference maximum value is understepped back again by the measured current value of the working gas, at which time the monitoring device 37 supplies a corresponding switchover command over the line 38 to the changeover switch 36, which then reverts to establishing its first switching path and connects the corresponding fuel supply means 30 again to the common fuel control for all combustion chambers 1.

As can be gathered from the drawing, the kind of air and fuel control with reference to temperature provided by the present invention involves a minimum outlay for components for obtaining an optimized and relatively constant combustion mixture in each combustion chamber. Moreover, in this manner because of the working-gas temperature being constantly held high independently of the momentary power requirements, a continuously optimized efficiency of the hot gas motor is obtained.

Although the invention has been described with reference to a particular illustrative embodiment, it will be recognized that modifications and variations are possible within the inventive concept. As already mentioned, for example, the pressure-detecting device 27 may be located either upstream or downstream of the blower 24.

We claim:

1. A multicylinder hot gas engine in which each cylinder possesses a combustion chamber and a gas-heating chamber, and is provided with means for supplying fuel and air to said combustion chambers, for heating a working gas in the corresponding heating chamber, in quantities that are controllable in proportion by a control system in response to temperature changes of the working gas resulting from load changes of the motor, said engine comprising the improvement which consists in that:

in each heating chamber (2) a measuring device (19) is provided for monitoring the working gas temperature therein;

means (21) are provided for selecting the lowest working gas temperature measured in the various cylinders and for controlling in response thereto the air supply for all combustion chambers (1);

fuel supply control means (30) having a throttle valve (31) and an electrical valve setting mechanism (32,33) are interposed in each of the respective fuel supply lines (4) individually feeding the several combustion chambers (1);

means (28,29) are provided for supplying to each of said fuel supply control means (30) simultaneously a fuel control signal proportional to the quantity of air required by the combustion chambers, and monitoring means (37,40) are provided for producing a reduction of the fuel throughput to said fuel control means (30) of each combustion chamber whenever the temperature in the corresponding heating chamber rises beyond a predetermined limit value.

2. A multicylinder hot gas engine comprising the improvement defined in claim 1, in which said measuring devices (19) for monitoring the working gas temperature provide electrical signals over connections (20) to said selecting means, the latter being constituted in the form of electronic selection logic (21) for selecting the signal corresponding to the lowest working gas temperature and for furnishing the selected signal to an airflow control means (22) arranged to compare the selected value with a reference value to produce an error signal, which is then furnished as a control signal to a blower (24) for propelling air simultaneously to all combustion chambers (1) of the respective cylinders.

3. A multicylinder hot gas engine as defined in claim 2, in which said blower (24) is a rotary blower of variable speed of rotation driven by an electric drive (23) and in which the airflow to said combuston chambers (1) produced thereby is controlled by said airflow control means (22) so as to be proportional to the rate of rotation of said blower.

4. A multicylinder hot gas engine as defined in claim 2, in which each of said valve setting mechanisms (32,33) comprises a stepping motor (32) coupled to a part of said throttle valve (31) serving to vary the flow aperture cross-section of said throttle valve (31) and also an electrical control device (33) for said stepping motor (32) having two alternative control inputs (34,35).

5. A multicylinder hot gas engine as defined in claim 4, in which the first input (34) of each said electrical control device (33) for a stepping motor is connected through a first switching path of an electrical changeover switch (36) to a common control line (29) and thereby to a pressure converter (28) responsive to pressure measuring means (27) arranged before or after said blower (24) in the air supply line (25) for said engine, said pressure measuring means and pressure converter constituting said means for supplying a fuel control signal to each of said fuel supply control means (30), and in which the second input (35) of said electrical control devices are each connected through a second switching path of said respective changeover switches (36) for preparing the path for connection with said monitoring means.

6. A multicylinder hot gas engine having the improvement defined in claim 5, in which each said monitoring means (37) comprises a control device (40) designed to respond to a temperature exceeding a predetermined temperature which is slightly higher than the temperature corresponding to said reference value provided for said airflow control (22) to which temperature control device (40) the temperature indicating output of said measuring device (19) in the corresponding heating chamber (2) is continuously supplied, and in which the output of said temperature control device (40) occurring upon said temperature indicating signal exceeding said predetermined temperature is furnished as a switchover command to said changeover switch (36) of the corresponding fuel supply control means, whereby said fuel supply control means is disconnected from the command fuel supply control for all combustion chambers, and its valve setting mechanism (32,33) is subjected to a control signal for reducing the fuel supply of the corresponding combustion chamber.

7. A multicylinder hot gas engine as defined in claim 5, in which said pressure converter (28) is constituted as a pressure-to-voltage converter, and said control device (33) of each fuel supply control means (30) is constituted as an electrical analog-to-digital converter.

* * * * *